US009825359B2

(12) United States Patent
Lo Hine Tong et al.

(10) Patent No.: US 9,825,359 B2
(45) Date of Patent: Nov. 21, 2017

(54) ANTENNA DEVICE HAVING ROTATABLE STRUCTURE

(71) Applicant: THOMSON LICENSING, Issy les Moulineaux (FR)

(72) Inventors: Dominique Lo Hine Tong, Rennes (FR); Philippe Minard, Saint Medard sur Ille (FR); Anthony Aubin, Bourgbarre (FR)

(73) Assignee: Thomson Licensing, Issy-les Moulineaux (FR)

( * ) Notice: Subject to any disclaimer, the term of this patent is extended or adjusted under 35 U.S.C. 154(b) by 79 days.

(21) Appl. No.: 15/060,441

(22) Filed: Mar. 3, 2016

(65) Prior Publication Data

US 2016/0261041 A1 Sep. 8, 2016

(30) Foreign Application Priority Data

Mar. 3, 2015 (EP) ..... 15305326

(51) Int. Cl.

| | |
|---|---|
| ***H01Q 1/24*** | (2006.01) |
| ***H01Q 3/08*** | (2006.01) |
| ***H01Q 1/08*** | (2006.01) |
| ***H01Q 1/22*** | (2006.01) |
| ***H01Q 3/04*** | (2006.01) |

(52) U.S. Cl.

CPC ..... *H01Q 3/08* (2013.01); *H01Q 1/084* (2013.01); *H01Q 1/2258* (2013.01); *H01Q 1/2275* (2013.01); *H01Q 1/24* (2013.01); *H01Q 3/04* (2013.01)

(58) Field of Classification Search

CPC ..... H01Q 1/24; H01Q 1/084; H01Q 1/2258; H01Q 1/2275; H01Q 3/04; H01Q 3/08

See application file for complete search history.

(56) References Cited

U.S. PATENT DOCUMENTS

| | | | | |
|---|---|---|---|---|
| 5,317,325 A | | 5/1994 | Bottomley | |
| 5,969,685 A | | 10/1999 | Hayes et al. | |
| 6,062,912 A | * | 5/2000 | Witczak | H01Q 1/084 439/578 |
| 7,042,404 B2 | | 5/2006 | Jo et al. | |
| 7,468,701 B2 | | 12/2008 | Fujikawa et al. | |

(Continued)

FOREIGN PATENT DOCUMENTS

| | | |
|---|---|---|
| CN | 103618676 A | 3/2014 |
| WO | 2007/007318 A2 | 1/2007 |

OTHER PUBLICATIONS

Ali et al., "Planar Array Antenna with Parasitic Elements for Beam Steering Control", Progress in Electromagnetics Research Symposium Proceedings, Aug. 18-21, 2009, pp. 181-185, Moscow, Russia.

*Primary Examiner* — Hoang Nguyen

(74) *Attorney, Agent, or Firm* — Volpe and Koenig, P.C.

(57) ABSTRACT

An architecture for providing a low cost, high performance antenna for small devices In particular, a rotatable antenna that having three antenna elements; a primary element consisting of a radiating element and swiveling cylindrical head, a secondary element that consists of a feeding cylindrical pin attached vertically to an electronic device main board, and a third element that consists of a plastic part over-molding the secondary element to permit electromagnetic coupling accuracy between the primary and secondary elements.

10 Claims, 7 Drawing Sheets

(56) References Cited

U.S. PATENT DOCUMENTS

| | | | | |
|---|---|---|---|---|
| 7,986,277 | B2 * | 7/2011 | Li | H01Q 1/242 343/702 |
| 8,102,320 | B2 * | 1/2012 | Lin | H01Q 1/242 343/702 |
| 2006/0273980 | A1 | 12/2006 | Chan | |
| 2007/0247375 | A1 * | 10/2007 | Huang | H01Q 1/084 343/702 |
| 2008/0165078 | A1 | 7/2008 | Song | |

* cited by examiner

ANTENNA DEVICE HAVING ROTATABLE STRUCTURE

This application claims the benefit, under 35 U.S.C. §119 of European Patent Application No. 15305326.9, filed Mar. 3, 2015.

FIELD OF THE INVENTION

The present invention generally relates to an antenna, and more particularly, to an architecture for a rotatable antenna for small devices with a radiating element and a swiveling coupler. The coupler is electromagnetically coupled to a pin rigidly connected to a PCB.

BACKGROUND INFORMATION

Recently small media streaming devices has become common on the marketplace. These devices stream media wirelessly from the internet and user wireless remote controls to control the device. Turning now to FIG. 1, two examples 100 of media streaming devices 110, 120 are shown. These very low-cost pocket-size set-top-boxes or media sticks integrate a wireless communications system in order to communicate with other devices, such as gateways, PCs, routers, remote controls, smartphones, tablets, etc. The antennas are mostly embedded in the housing, as is shown with the first media device 110 but some devices are equipped with an external antenna as is shown with the second media device 120. External antennas afford better wireless transmission performance than the embedded because of a better radiation efficiency and a better radiation pattern of the antenna.

Generally, wireless antennas embedded in small electronic devices, such as USB dongle devices, exhibit very poor performance, in terms of gain, radiation efficiency and radiation pattern. The size of the small electronic device does not enable optimal antenna design as the smaller the size of an antenna with respect to the radiating wavelength, the lower its radiation efficiency. Antenna electromagnetic behavior is very sensitive to conductive objects in its close environment, such as interface connectors, circuit shielding covers, cables, and shielded equipment housings to which the small device is connected. In addition, embedded antennas are often printed on the main circuit board. When a device with an embedded antenna is placed in the back side of a display, the wireless connection could be drastically impaired because of a lack of "visibility".

Therefore, it is desirable to provide a compact, low cost, external antennas which can be configured by a user, in a way to avoid these undesirable wireless performance issues and to offer a more flexible way to improve the coverage performance according the conditions of visibility of the device.

SUMMARY OF THE INVENTION

In accordance with an aspect of the present invention, an antenna is disclosed comprising a feed element, a first element having a cylindrical portion, a second element fixed to said feed element, and a third element fixed to said second element and rotationally fixed to an outside surface of said cylindrical portion of such that a space is maintained between said cylindrical portion and said second element.

In accordance with another aspect of the present invention, an apparatus is disclosed comprising a printed circuit board, a cylindrical antenna element affixed at one base to the printed circuit board such that an axis of said cylindrical antenna element is orthogonal to a plane of said printed circuit board, a radiating antenna element having a hollow cylindrical portion, wherein said hollow cylindrical portion is positioned over a portion of said cylindrical antenna element, and a nonconductive element affixed to a portion of said cylindrical antenna element and positioned over said hollow cylindrical portion such that a gap is maintained between said cylindrical antenna element and said hollow cylindrical portion.

In accordance with another aspect of the present invention, a rotatable antenna is disclosed comprising a first element electrically coupled to a printed circuit board, where the first element comprises a first cylindrical portion, a second element having a second cylindrical portion, said second cylindrical portion having a cavity for receiving said first cylindrical portion such that said second element rotates around an axis of said first element, and a third element immovably fixed to a portion of said first element and movably fixed to a portion of said second cylindrical portion such that said second cylindrical portion is prevented from touching said first cylindrical portion.

In accordance with another aspect of the present invention, an apparatus is disclosed comprising a printed circuit board, an enclosure for enclosing at least a portion of said printed circuit board, said enclosure having a circular aperture over a portion of said printed circuit board, a cylindrical antenna element affixed at to the printed circuit board such that an axis of said cylindrical antenna element is orthogonal to a plane of said printed circuit board, said axis also being in alignment with said aperture, and a radiating antenna element having a cylindrical portion, wherein said cylindrical portion is positioned over a portion of said cylindrical antenna element, and wherein said cylindrical portion is positioned within said aperture of said enclosure such that cylindrical portion is movably retained by said enclosure such that a gap is maintained between said cylindrical antenna element and said cylindrical portion

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

The exemplifications set out herein illustrate preferred embodiments of the invention, and such exemplifications are not to be construed as limiting the scope of the invention in any manner.

DESCRIPTION OF THE PREFERRED EMBODIMENTS

As described herein, the present invention provides an architecture for a rotatable compact antenna for use in electronic products. While this invention has been described as having a preferred design, the present invention can be further modified within the scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

Figure 1:
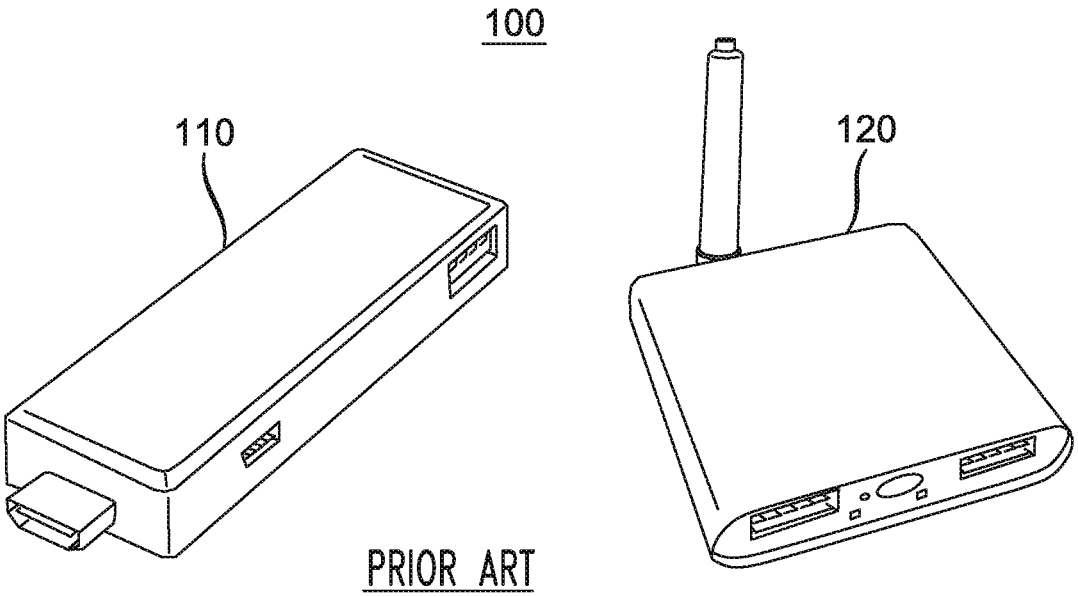
FIG. 1 is a diagram showing prior art example of small wireless media devices.
Figure 2:
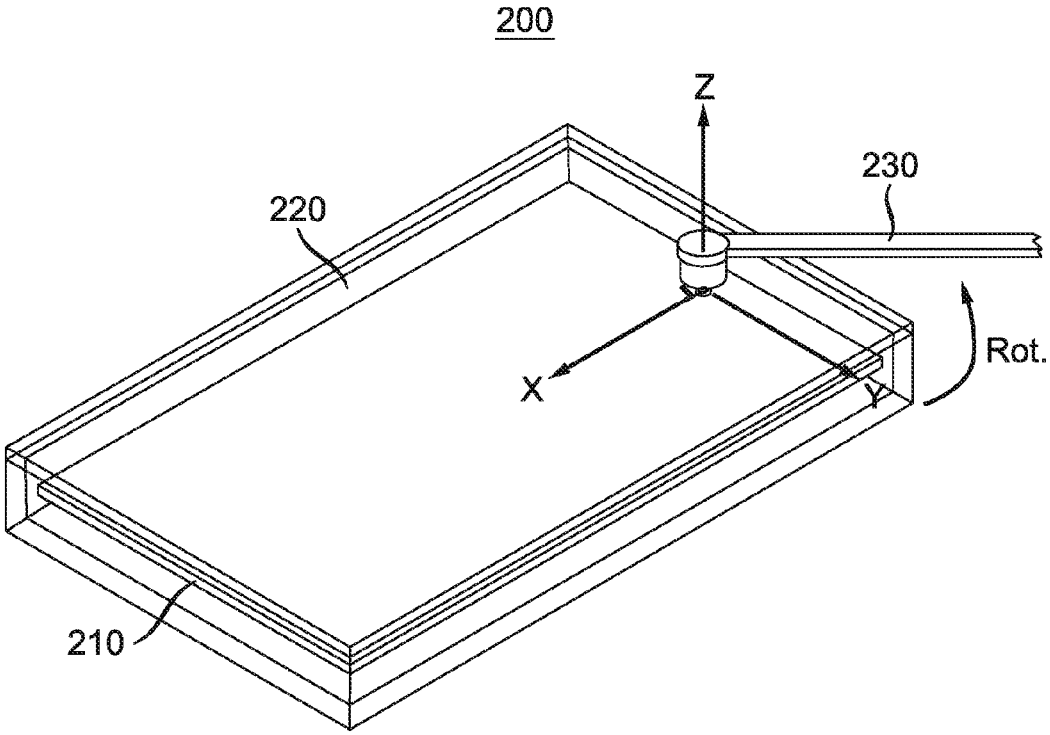
FIG. 2 is a diagram of device showing an exemplary embodiment the present invention.

Referring now to the drawings, and more particularly to FIG. 2, an exemplary embodiment of a device 200 embodying aspects of the present invention is shown. The exemplary device 200 consists of a printed circuit board 210, a device housing 220, and a rotational antenna 230. The device 200 may be a small "set back" box which receives streaming media wirelessly from a gateway server or a router to the device 200 and wirelessly transmits control information back to the server. The housing 210 may be constructed of metal or plastic. A plastic housing 210 may include some conductive shielding elements to reduce the transmission of unwanted electromagnetic interference. These conductive shielding elements may be coupled to the housing or to the printed circuit board 220.

The printed circuit board 220 is mounted within the housing 210 and includes a wireless transmitter, a wireless receiver, and a processor among other functional circuitry. The printed circuit board 220 has components affixed to one or more surfaces of the circuit board 220 including a portion of the rotational antenna 230. The portion of the rotational antenna is electrically coupled to the transmitter and receiver portions of the device 200.

Figure 3:
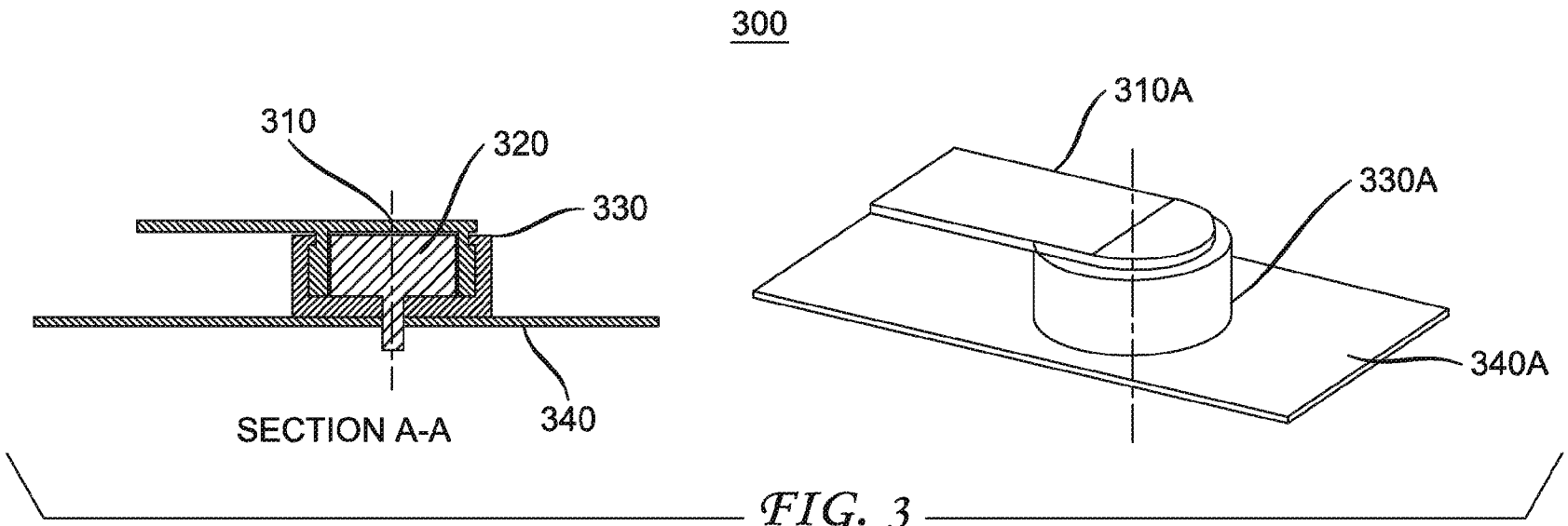
FIG. 3 is a diagram and cross section and perspective view of an exemplary rotational portion of the rotational antenna is shown.

Turning now to FIG. 3, a diagram and cross section and perspective view 300 of an exemplary rotational portion of the rotational antenna is shown. The rotatable antenna 230 comprises three antenna elements, the primary element 310, the secondary element 320 and the third element 330. The primary element 310 comprises a radiating metal element connected to a cylindrical swiveling head that may be coupled to the antenna assembly through an aperture made in the device housing. This primary element 310 includes also a cylindrical cavity which is coaxially aligned with the secondary element 320. This secondary element comprises a conductive cylindrical pin which is attached perpendicularly by soldering or conductively coupling to the printed circuit board 340 of the device. As shown in FIG. 3, the lower portion of the secondary element 320 may have a narrower diameter than the upper portion of the secondary element 320. The diameter of each portion of the secondary element 320 can be changed in response to design requirements and are not required to be differing diameters. The upper portion of the secondary element 320 is inserted in the air cavity of the primary element 310. Both elements are not physically connected but air-spaced. Alternatively, a dielectric spacer may be used to aid in isolating the primary element 310 from the secondary element 320. The primary element 310 rotates around the coaxial axis. Thus, the primary element 310 is first fed a signal by the secondary element 320 using the electromagnetic coupling between the secondary element 320 and the primary element 310 across the air gap.

Ideally, a relative consistent tolerance is desired on the electromagnetic coupling for the distance between the primary element 310 and the secondary element 320. The third element 330 is introduced to maintain the spacing. This third element 330 consists of a dielectric part, over-molding a portion of the second element 320, with a base lying onto the printed circuit board 340, and comprising a cavity hosting the swiveling head of the first element 310.

The design of the third element 330 aims at accommodating several requirements. To ensure the perpendicularity of the secondary element with respect to the PCB plane, the base of the third element 330 is mounted on top of the printed circuit board 340 and over-molded on the secondary element 320. To ensure that the primary element 310 and the secondary element 320 are correctly aligned coaxially the cylindrical portion of the primary element 310 is hosted in the cavity of the secondary element 320 with tight tolerances. By this way, the desired air spacing in the XY plane, between the primary and secondary elements, is also maintained. Finally, to maintain the required air spacing in the Z axis, the cylindrical portion of the primary element 310 is abutted against the hosting internal base of the third element 330. In addition, a clip (not shown) on top of the third element 330 restricts the withdrawal of the primary element 310 from the hosting third element 330.

In the perspective view, the primary element 310A is shown with a cylindrical portion inserted in the third element 330A, such that the radiating portion of the primary element can rotate in the plane of the printed circuit board 340A. The third portion keeps the primary portion 310A consistently coupled to the radiating portion of the secondary element (not shown). There plane of rotation is not limited to the angle formed by the radiating portion of the printed circuit board 340A. The radiating portion may be bent, or the elements may be modified in such a way that rotation occurs in a plane other than that of the printed circuit board 340A.

The third element 330 may be molded with a key or flange operative to engage a groove on the primary element 310. Thus, the primary element 310 can be rotated without becoming disengaged from the third element 330. As show in FIG. 3, the third element has a small upper portion with a smaller inner diameter than the rest of the third element. This small upper portion is designed to mate with a small portion of the outer surface of the cylindrical cavity of the primary element. The small portion of the outer surface of the cylindrical cavity has a smaller outer diameter than the rest of the cylindrical cavity. Thus, when the cylindrical cavity is inserted into the third element 330 the small upper portion of the third element engages with the small portion of the outer surface of the cylindrical cavity in such a way that a resistance is created. This resistance prevents the primary element from being extracted from the third element during normal operation. Once enough force is applied to overcome the resistance, the primary element can be extracted.

Figure 4:
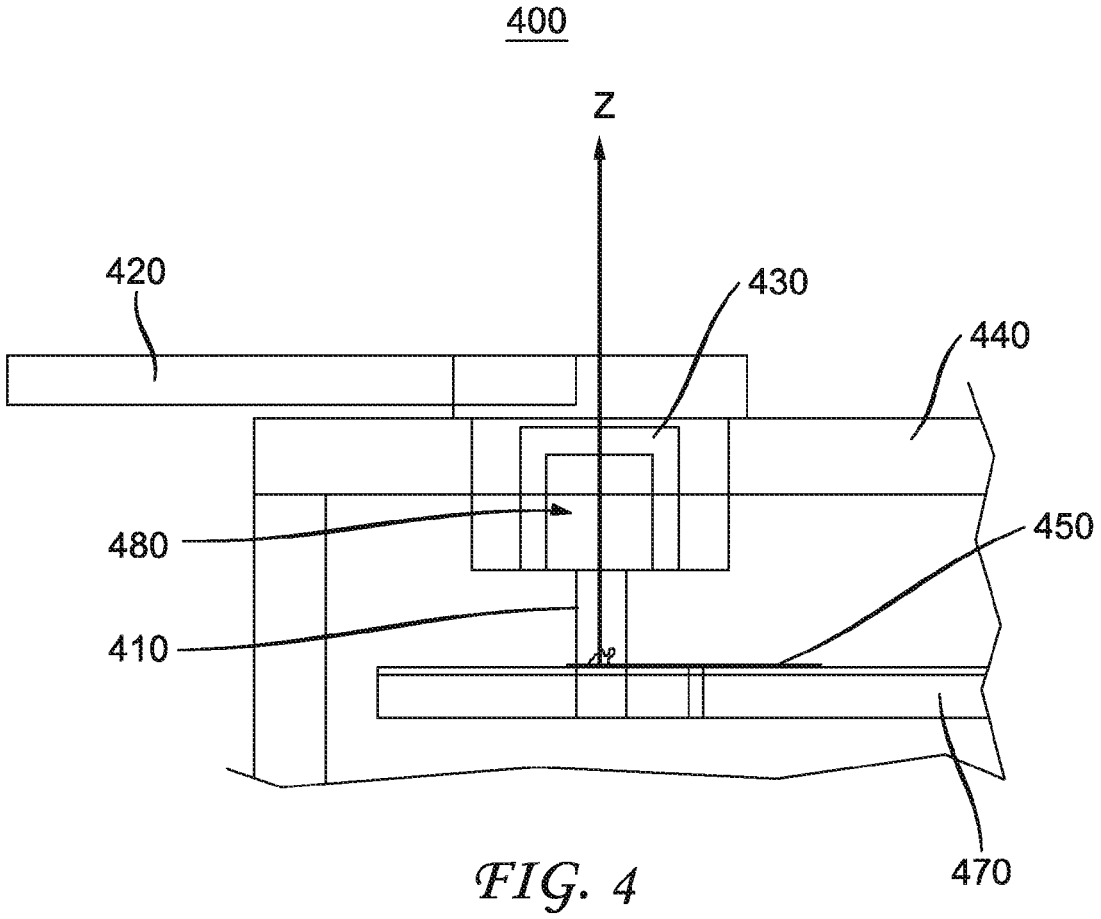
FIG. 4 is a diagram showing a second cross section of exemplary rotational portion of the antenna 400 according to the present invention.

Turning now to FIG. 4, a second cross section of exemplary rotational portion of the antenna 400 according to the present invention is shown. A printed circuit 470 is shown mounted within a portion of a product enclosure 440. A feed element 410 of the secondary element is shown conductively coupled to the printed circuit board 470 such that said feed element 410 is positioned perpendicular to the plane of the printed circuit board 470. The feed element is coupled to an upper portion 480 of the secondary element. The upper portion 480 of the secondary element is shown spaced from the primary element 420 by a dielectic gap 430. The dielectric gap may include plastic, air, or another non conductive material. In this exemplary embodiment, the product enclosure 440 is used to hold the rotating cylindrical portion of the primary element 420. The printed circuit board 470 is also affixed to the product enclosure 440 thereby maintaining the geometry between the upper portion of the secondary element 480. A conductive printed circuit board trace 450 is used to conduct the signal to be transmitted or received by the antenna to further processing circuitry.

Figure 5:
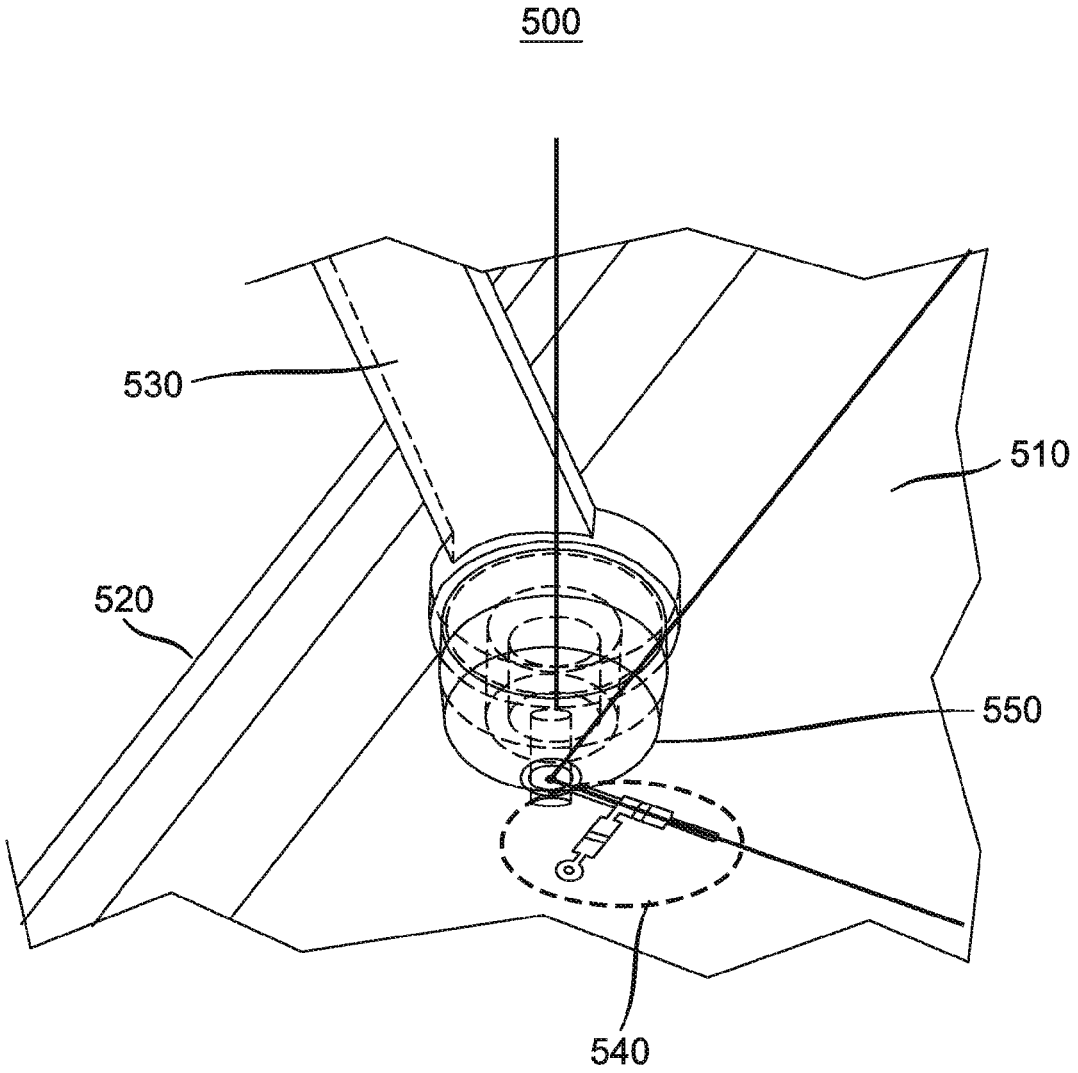
FIG. 5 is a diagram is shown of a perspective view of an exemplary rotating portion of the antenna.

Turning now to FIG. 5, a perspective view of an exemplary rotating portion 500 of the antenna is shown. In this embodiment, the rotational antenna structure 530 is shown affixed to the printed circuit board 510. The third element 550 is used to maintain spacing between the primary element and the secondary element. In this exemplary embodiment, the third element 550 is rigidly affixed to the printed circuit board 510 and is independent of the product enclosure 520. An impedance matching circuit 540 is shown on the printed circuit board 540. The printed circuit board 510 is shown mounted inside a product enclosure 520. The product enclosure 520 may have a cover with an aperture to permit the extension of the rotatable antenna. Alternatively, a cover may be omitted.

Figure 6:
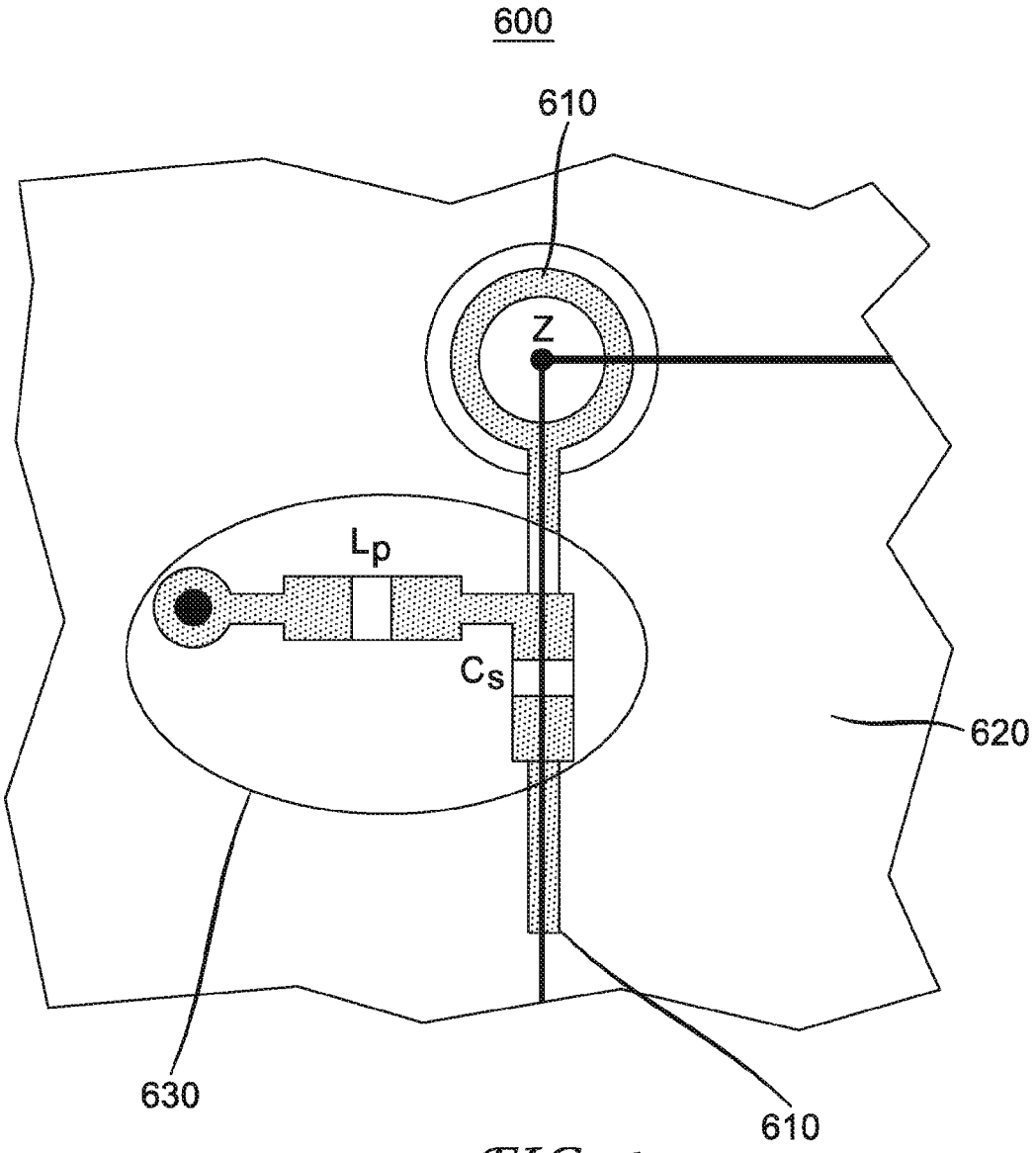
FIG. 6 is an exemplary printed circuit board configuration according to the present invention.

Turning now to FIG. 6, an exemplary printed circuit board configuration 600 according to an aspect of the present invention is shown. The printed circuit board 620 has affixed to a surface a metalized via-hole 610 in which is inserted the feeding pin of the secondary element (not shown). The secondary element and the associated third element can be mounted on the printed circuit board 620 following a common surface mount technology (SMT) process, with wave-soldering process or the line performed on the bottom side. A signal is then fed to the pin through an impedance matching circuit 630, for example an L-shape type, and a microstrip line 640.

Figure 7:
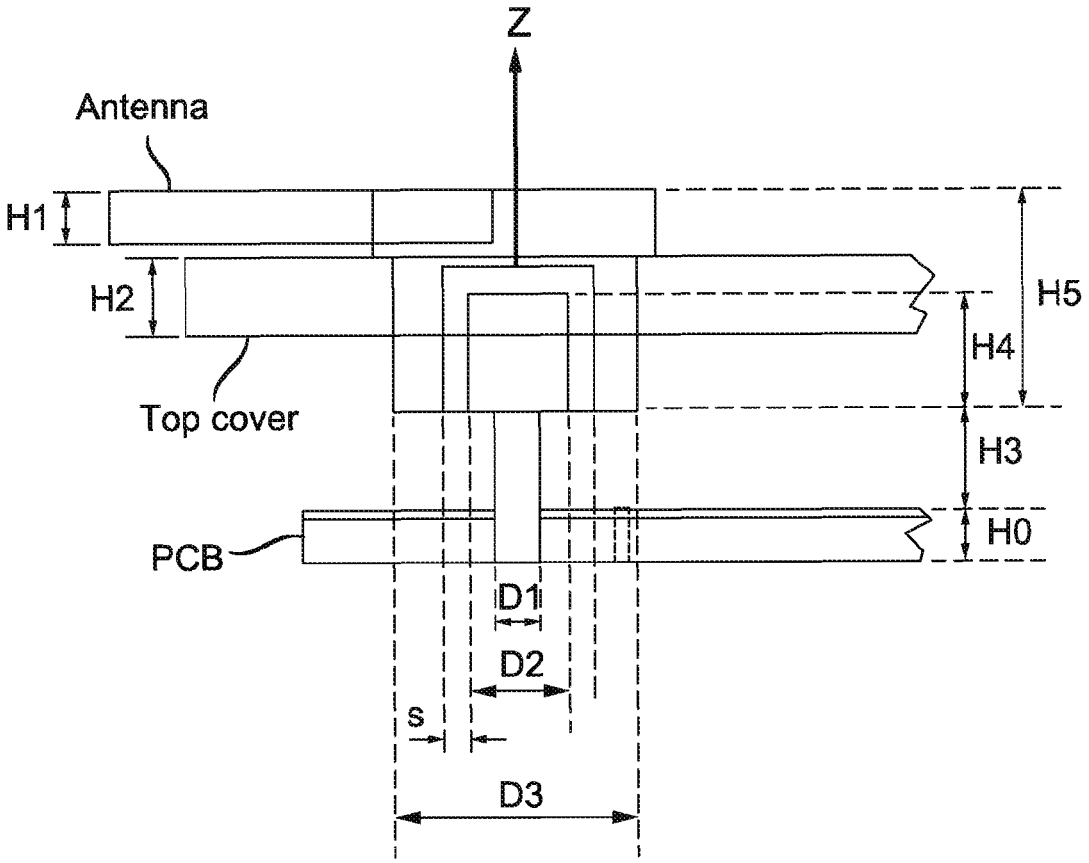
FIG. 7 is an exemplary of the mechanical dimensions of an antenna for a particular application in the Wi-Fi 2.4GHz band according to the present invention.

FIG. 7 is an exemplary of the mechanical dimensions of an antenna for a particular application in the Wi-Fi 2.4 GHz band according to an example of the present invention.

The following table shows the values of the parameters of the antenna of the example shown in FIG. 7.

| Parameter | Definition | Value (mm) |
|---|---|---|
| H0 | PCB thickness (ground plane at 0.125 mm below the top surface) | 1.0 |
| H1 | Antenna rectangular arm thickness | 1.0 |
| H2 | Top cover thickness | 1.5 |
| H3 | Height of the small diameter of the feeding pin (from the PCB) | 2.0 |
| H4 | Height of the large diameter of the feeding pin | 2.3 |
| H5 | Total height of the rotatable antenna head | 4.3 |
| D1 | The small diameter of the feeding pin1.0 | 1.0 |
| D2 | The large diameter of the feeding pin | 2.2 |
| D3 | Outer diameter of the rotatable head (inside the housing) | 5.2 |

-continued

| Parameter | Definition | Value (mm) |
|---|---|---|
| S | Air gap (isolation) between the feeding pin and the rotatable head | 0.5 |
| Other | Housing size | 90*55*11 |
| | Length of the antenna arm | 40 |

Besides devices with small dimensions, the antenna of the embodiment of the invention can be used in devices where the housing is in metal, for reasons of aesthetic, and thus inside which it is impossible to embed the antennas. Other applications may include multi-band LTE gateways, for which the external stick antennas can achieve better radiation patterns and performances in comparison with fully embedded antennas.

While the present invention has been described in terms of a number of specific embodiments, it will be appreciated that modifications may be made which will fall within the scope of the invention. For example, various antenna lengths, mounting configurations and/or antenna driving circuits may be implemented separately or combined, and may be implemented in general purpose discrete components or dedicated data processing hardware.

The invention claimed is:

1. An rotatable antenna, comprising:

a first element electrically coupled to a printed circuit board, where the first element comprises a first cylindrical portion;

a second element having a second cylindrical portion, said second cylindrical portion having a cavity for receiving said first cylindrical portion such that said second element rotates around an axis of said first element; and a third element immovably fixed to a portion of said first element and movably fixed to a portion of said second cylindrical portion such that said second cylindrical portion is prevented from touching said first cylindrical portion.

2. The rotatable antenna of claim 1, wherein a space is maintained between said first cylindrical portion of said first element and said second cylindrical portion of said second element.

3. The rotatable antenna of claim 2, wherein said space is an air gap.

4. The rotatable antenna of claim 1, wherein a signal is electromagnetically coupled between said first cylindrical portion of said first element and said second cylindrical portion of said second element.

5. The rotatable antenna of claim 1, wherein said third element is fabricated from a dielectric material.

6. The rotatable antenna of claim 1, wherein said first element comprises a third cylindrical portion which is coupled to the printed circuit board.

7. An apparatus comprising:

a printed circuit board;

an enclosure for enclosing at least a portion of said printed circuit board, said enclosure having a circular aperture over a portion of said printed circuit board;

a cylindrical antenna element affixed to the printed circuit board such that an axis of said cylindrical antenna element is orthogonal to a plane of said printed circuit board, said axis also being in alignment with said aperture; and a radiating antenna element having a cylindrical portion, wherein said cylindrical portion is positioned over a portion of said cylindrical antenna element, and wherein said cylindrical portion is positioned within said aperture of said enclosure such that cylindrical portion is movably retained by said enclosure such that a gap is maintained between said cylindrical antenna element and said cylindrical portion.

8. The apparatus of claim 7 wherein the gap is an air gap.

9. The apparatus of claim 7 wherein a signal is electromagnetically coupled between said cylindrical antenna element and said cylindrical portion.

10. The apparatus of claim 7 wherein said radiating antenna element can be rotated around an axis of said cylindrical antenna element.

* * * * *